US007472563B2

(12) United States Patent
Knoll et al.

(10) Patent No.: US 7,472,563 B2
(45) Date of Patent: Jan. 6, 2009

(54) SUBMERGED EVAPORATOR WITH INTEGRATED HEAT EXCHANGER

(75) Inventors: Istvan Knoll, Hoejbjerg (DK); Claes Stenhede, Verona (IT)

(73) Assignee: Alfa Laval Corporate AB, Lund (SE)

( * ) Notice: Subject to any disclaimer, the term of this patent is extended or adjusted under 35 U.S.C. 154(b) by 434 days.

(21) Appl. No.: 10/501,537

(22) PCT Filed: Jan. 17, 2003

(86) PCT No.: PCT/DK03/00030

§ 371 (c)(1),
(2), (4) Date: Oct. 22, 2004

(87) PCT Pub. No.: WO03/060411

PCT Pub. Date: Jul. 24, 2003

(65) Prior Publication Data

US 2005/0039486 A1 Feb. 24, 2005

(30) Foreign Application Priority Data

Jan. 17, 2002 (DK) ..... 2002 00075

(51) Int. Cl.
*F25B 39/02* (2006.01)

(52) U.S. Cl. ..... 62/515; 62/516; 165/159

(58) Field of Classification Search ..... 165/145, 165/166, 167, 160, 157, 159; 162/516; 62/516, 62/512, 515

See application file for complete search history.

(56) References Cited

U.S. PATENT DOCUMENTS 2,655,350 A * 10/1953 Gaylord, Jr. ..... 165/160

(Continued)

FOREIGN PATENT DOCUMENTS

DE 1 153 040 8/1963

(Continued)

OTHER PUBLICATIONS

Machine translation of EP 0758073.*

(Continued)

*Primary Examiner*—Mohammad M Ali
(74) *Attorney, Agent, or Firm*—David S. Safran; Roberts Mlotkowski Safran & Cole, P.C.

(57) ABSTRACT

The invention provides a submerged evaporator (14) with integrated plate heat ex-changer (4) that may operate with markedly increased capacity, where the evaporator (14) does not require more space than other known types and have a smaller filling volume of refrigerant (10) than prior art units. The integrated plate heat exchanger (4) is built up with an outer contour that substantially follow the lower contour of the casing (6) and the liquid level, where the integrated heat exchanger (4) has at least one inlet connection (24.1) and at least one outlet connection (24.2) for secondary refrigerant (26), and where the upper volume of the casing acts as a liquid separator. With such design, much less space is occupied than with prior art types of submerged evaporators. The reason is that the internal volume is better utilised. Typically, there is a cylindric casing (6) with welded or screwed on ends (22), where internally there is mounted a plate heat exchanger (4) having a part cylindric shape and an external diameter which is between 5 and 15 mm less than the internal diameter of the casing (6). Hereby is achieved a submerged evaporator (14) with reduced filling of refrigerant (10).

12 Claims, 3 Drawing Sheets

Figure 1:
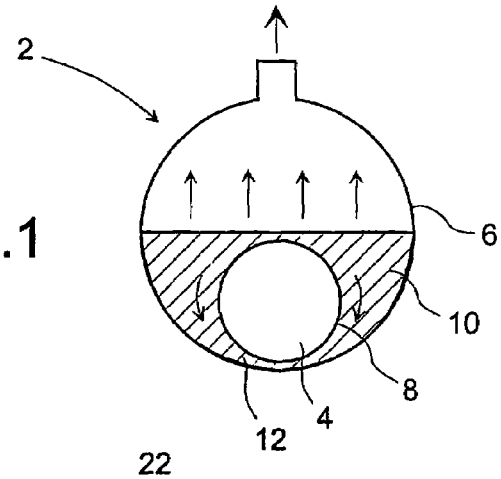

U.S. PATENT DOCUMENTS 3,048,373 A * 8/1962 Bauer et al. ..... 165/301
3,289,757 A * 12/1966 Rutledge ..... 165/166
3,538,718 A 11/1970 Karbosky
3,720,071 A 3/1973 Nasser et al.
3,734,168 A * 5/1973 DeGroote ..... 165/11.1
3,840,070 A 10/1974 Becker et al.
4,073,340 A 2/1978 Parker
4,437,322 A 3/1984 Ertinger
4,473,034 A * 9/1984 Raudabaugh et al. ..... 122/18.4
5,789,244 A 8/1998 Heidrun et al.
6,007,806 A 12/1999 Lathe et al.
6,013,240 A 1/2000 Behr et al.
6,086,913 A 7/2000 Tam et al.
6,107,286 A 8/2000 Byk et al.
6,143,729 A 11/2000 Lehn et al.
6,158,238 A 12/2000 Lampinen et al.
6,171,612 B1 1/2001 Byk et al.
6,200,956 B1 3/2001 Scherman et al.
6,393,864 B1 5/2002 Darredeau
6,528,315 B2 3/2003 Bureau et al.
6,534,484 B1 3/2003 Wheeler et al.
6,696,420 B1 2/2004 Perricaudet et al.
6,743,623 B2 6/2004 Perricaudet et al.
6,811,774 B2 11/2004 Haddada et al.
6,884,430 B1 4/2005 Crouzet et al.
6,918,433 B2 * 7/2005 Kontu ..... 165/160

FOREIGN PATENT DOCUMENTS

| | | | |
|---|---|---|---|
| DE | 35 11 829 | A1 | 10/1986 |
| EP | 0 140 308 | | 5/1985 |
| EP | 0 185 573 | | 6/1986 |
| EP | 0 259 212 | | 3/1988 |
| EP | 0 758 073 | A1 | 2/1997 |
| GB | 901 077 | | 7/1962 |
| GB | 2 028 995 | A | 3/1980 |
| WO | WO 96/02655 | | 2/1996 |
| WO | WO 96/04932 | | 2/1996 |
| WO | WO 96/17823 | | 6/1996 |
| WO | WO 96/25508 | | 8/1996 |
| WO | WO 96/30051 | | 10/1996 |
| WO | WO 96/40964 | | 12/1996 |
| WO | WO 97/11682 | | 4/1997 |
| WO | WO 97/18185 | | 5/1997 |
| WO | WO 97/31935 | | 9/1997 |
| WO | WO 97/45689 | | 12/1997 |
| WO | WO 99/01157 | | 1/1999 |

OTHER PUBLICATIONS

International Search Report dated May 16, 2003.

* cited by examiner

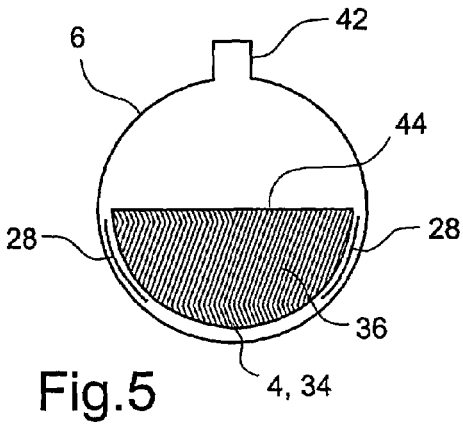
Fig.5
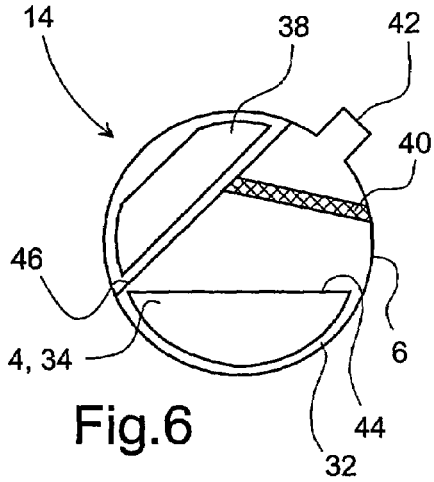
Fig.6
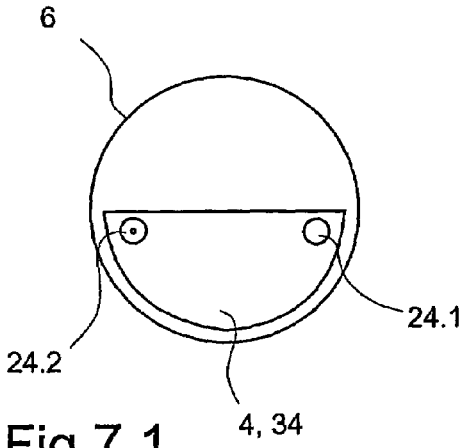
Fig.7.1
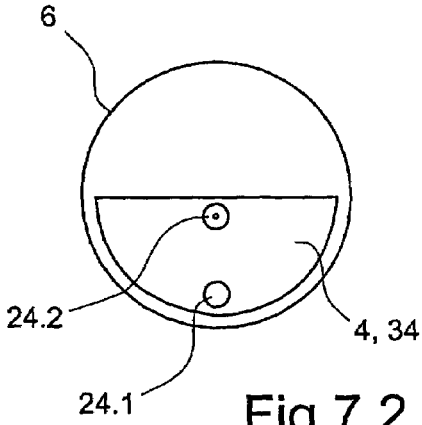
Fig.7.2
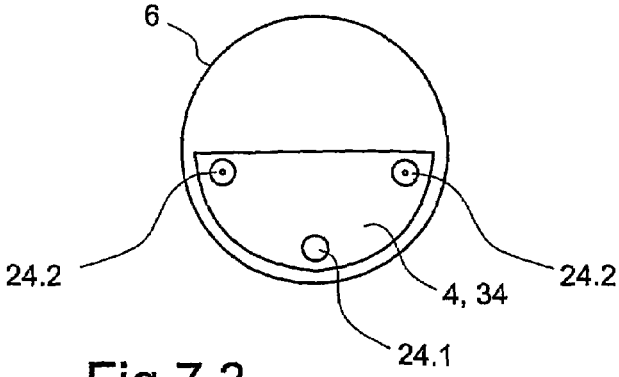
Fig.7.3

SUBMERGED EVAPORATOR WITH INTEGRATED HEAT EXCHANGER

The present invention concerns a submerged evaporator contained in a casing and including at least one submerged plate heat exchanger, where the submerged plate heat exchanger has at least one inlet connection and at least one outlet connection for a secondary refrigerant, where the plate heat exchanger is disposed at the bottom of the casing, where a primary refrigerant may flow around the plate heat exchanger and a secondary refrigerant may flow through the plate heat exchanger, and where the uppermost part of the casing is used as a liquid separator.

Using a submerged evaporator is a known method of heat transmission between two separate media. One of the commonly known methods is to incorporate a cylindric plate heat exchanger in a cylindric casing. Above this casing is mounted a liquid separator typically having the same size as the casing enclosing the plate heat exchanger. This solution has, among others, the drawback that relatively much space is occupied in height simultaneously with, due to the height of the unit, there being a large static pressure suppressing the evaporation, particularly at lower temperatures, thus reducing efficiency. Furthermore, a pressure loss occurs between evaporator and the separate liquid separator, also reducing capacity.

EP 0 758 073 describes a refrigeration device in a closed refrigerant circuit for cooling a cold transfer medium, in particular a water/brine mixture, in the refrigerant circuit a compressor sucking in gaseous refrigerant from a vapour drum, compressing the said refrigerant and supplying it at high pressure to a condenser, from which, after pressure expansion, the liquid refrigerant is supplied via the liquid space of the vapour drum to an evaporator, in which heat is extracted from the cold transfer medium as a result of the evaporation of the refrigerant, and from which the gaseous refrigerant is supplied once again to the vapour space of the vapour drum, the heat exchanger surface of the evaporator being designed as a plate heat exchanger with media conveyed in cross-current and counter-current to one another and being arranged in the liquid space of the vapour drum, where the heat exchanger surface of the plate heat exchanger is submerged into the vapour drum, designed as a pressure-resistant housing, in such a way that the supply connection piece and the discharge connection piece are arranged on one side and the deflection chamber for the cold transfer medium flowing horizontally through the plate heat exchanger is arranged on the other side, outside the housing of the vapour drum, and defining fall ducts for the refrigerant circulated by natural circulation as a result of gravity are formed between the two side walls of the plate heat exchanger and the housing walls of the vapour drum which are parallel thereto.

In this solution part of the heat exchanger is placed outside the vapour drum. Different parts of the heat exchanger are subjected to different pressures; the part outside the drum is subjected to atmospheric pressure, where the part inside the drum is subjected to the evaporation pressure inside the drum. Depending on the cooling media used, the pressure difference can be very high. The heat exchanger is box-shaped, and that form leaves a lot of unused space around the box especially under the box and along the two sides. This space takes up a large volume of unused cooling media. The strength of the box-shaped heat exchanger is not sufficient if a high pressure difference occurs. In one embodiment, the passive volume is reduced by out filler volumes placed near the bottom of the drum. The static pressure around the heat exchanger is relatively high because of the upright drum, and the static pressure reduces evaporation because steam bubbles formed by evaporation have a reduced sizes.

U.S. Pat. No. 4,437,322 describes a heat exchanger assembly for a refrigeration system. The assembly is a single vessel construction having an evaporator, condenser and flash subcooler. A plate inside the shell separates the evaporator from the condenser and the flash subcooler, and a partition inside the vessel separates the condenser from the flash subcooler. The heat exchanger assembly includes a cylindrical shell having a plurality of tubes disposed in parallel to the longitudinal axis of the cylindrical shell.

By placing the tubes inside the shell, there is no pressure differential over the heat exchanger, but the heat exchanger has a reduced surface as formed by longitudinal tubes. Over the heat exchanger there is only a limited space, and a small amount of liquid refrigerant might be sucked out of the vessel.

A heat exchanger assembly is also disclosed in U.S. Pat. No. 4,073,340. A heat exchanger of the shaped plate type with a stack of relatively thin interspaced heat transfer plates. The plates of the heat exchanger are arranged to define sets of multiple counterflow fluid passages for two separate fluid media alternating with each other. Passages of one set communicate with opposed manifold ports on opposite sides of the core matrix. Passages of the other set pass through the stack past the manifolds in counterflow arrangement and connect with inlet and outlet portions of an enclosing housing. An assembly of two plates oppositely disposed establishes integral manifolds for one of the fluid media through the ports and the fluid passage defined between the plates. A third plate joined thereto further defines a passage for the second fluid media to flow between the inlet and outlet portions of the housing. The various fluid passages may be provided with flow resistance elements, such as baffle plates, to improve the efficiency of heat transfer between adjacent counterflow fluids. In each set of aligned ports, collars, alternately large and small, are formed in nested arrangement so that the ports formed by adjacent plates bridge the inner spaces between the plates. Such construction permits communication with the aligned ports of alternate fluid channels which are closed to the outside between the heat exchanger plates. In manufacturing a core matrix, the parts are formed and cleaned and the brazing alloy is deposited thereon along the surfaces to be joined. The parts are then stacked in the natural nesting configuration followed by brazing in a controlled-atmosphere furnace. The brazing is readily carried out due to the sealing construction of the described nesting arrangement.

This heat exchanger is designed for air to gas heat exchange. If the plates are used inside an evaporator, the shape of the plates leads to a casing containing a large volume of unused refrigerant.

The invention described in WO 97/45689 concerns a heat exchanger which has a plate stack and comprises first and second plates which are arranged alternately in rows and between which first and second channels are formed, these channels being connected via first and second connection regions to first and second connection openings. The first connection openings, first connection regions and first channels are completely separate from the second. The first and second plates each have on both sides a plurality of substantially straight main channels which are aligned in parallel in each plate. The first channels and second channels consist of first and second main channels and third and fourth main channels which mutually form a first angle and are formed on both sides of a first connection plane and a second connection plane in the form of half channels which are open towards the connection plane. The fourth main channels and second main channels are formed on one side of a first plate and second plate, and the first main channels and third main channels are formed on the other. The plates are metal sheets whose main channels on both sides take the form of beads which appear on one side of the metal sheet as depressions and on the other as burr-like projections. On one side of the metal sheet, a contact surface is provided along the periphery, and, on the other, two contact regions, each enclosing a passage opening, are provided, so that, by joining together the metal sheets with the same sides or planes in each case, contact surfaces and contact regions always alternately abut one another and are tightly interconnected, in particular welded or soldered together, in order to separate the first and second channels in a leak tight manner.

These problems have been attempted solved in another known type where in one and the same casing a plate heat exchanger and a liquid separator are incorporated. This is e.g. disclosed in U.S. Pat. No. 6,158,238. Here is described a heat exchanger which is built up with a cylindric casing having a diameter, which is markedly greater than the diameter of the built-in cylindrical plate heat exchanger, whereby the plate heat exchanger disposed at the bottom of the casing may be submerged by primary refrigerant while there is still space for a liquid separator function. This solution provides a relatively low static pressure, and no pressure drops problems between evaporator and liquid separator are present either as they are built together. This kind of submerged plate and casing heat exchanger, however, has the great disadvantage that a very large and in many cases unacceptable filling of the primary refrigerant is required, where a large part of the filling is actually just passive and uselessly provided between casing and plate heat exchanger. The efficiency of the system compared with space requirements is also not optimal since by this design there is needed a casing with a diameter which is often in the range 1.5-2 times the diameter of the built-in plate heat exchanger.

Another and very significant disadvantage of the above systems is that mixing occurs in the primary refrigerant between the upwards directed flow coming from evaporation of the primary refrigerant and the refrigerant in liquid state which is on its way back to the bottom of the casing. At the bottom of the casing may hereby occur a lack of refrigerant whereby the efficiency is considerably reduced.

It is the purpose of the invention to indicate a submerged evaporator with integrated plate heat exchanger that can operate with a markedly increased capacity compared with prior art heat exchangers, where the heat exchanger does not require more space than prior art evaporators, and furthermore where there is need for a considerably less filling volume of the primary refrigerant than in prior art units.

This may be achieved with a submerged evaporator with integrated plate heat exchanger as described in the introduction, where the plate heat exchanger is integrated in the liquid separator, and where the integrated plate heat exchanger is made with an outer contour that substantially follows the lower contour of the casing and the surface of the liquid level of the primary refrigerant.

With such a design of the plate heat exchanger, the size of the entire evaporator may be optimised so that substantially less space is occupied than by prior art types of submerged evaporator with the same capacity. The primary reason for this is that the internal volume is utilised better. A submerged evaporator of this type furthermore has a minimal static pressure and a minimal pressure loss between evaporator and liquid separator and of course a substantially less filling than a traditional evaporator with the same capacity. The integrated plate heat exchanger is made with a shape following the internal contour of the casing. Typically, we are speaking of a traditionally shaped cylindric casing with welded or screwed ends where internally there is fitted a plate heat exchanger having a partly cylindric shape, e.g. a semi-cylindrical shape, and an outer diameter which is 5-15 mm less than the inner diameter of the casing. With this design, there is achieved a submerged evaporator with a markedly reduced filling of primary refrigerant. In order to attain maximum effect of the submerged evaporator, it is, as indicated, to be submerged, and with a submerged evaporator according to the invention, only a limited volume is required as only a minimal waste volume is present, i.e. no large passive areas between the sides of the heat exchanger and the casing are to be filled by the primary refrigerant.

In an embodiment of the invention, a submerged evaporator with integrated plate heat exchanger is designed so that the longitudinal sides of the plate heat exchanger are closed for inflow or outflow of the primary refrigerant between the plates of the plate heat exchanger, and that in the bottom of the plate heat exchanger there is provided at least one opening through which the primary refrigerant flows in between the plates of the plate heat exchanger. With these closed sides is achieved the advantage that liquid carried with the evaporated refrigerant can be conveyed back to the bottom of the plate heat exchanger without mixing evaporating refrigerant and unevaporated refrigerant liquid on its way back to the bottom of the evaporator again is occurring.

In a preferred variant of the invention, longitudinal guide plates extending from an area in the vicinity of the top side of the plate heat exchanger and downwards against the bottom of the casing are provided in longitudinal gaps appearing between plate heat exchanger and casing, where the downwardly extension of the guide plates has a magnitude so that a longitudinal area at the bottom of the plate heat exchanger is held free from guide plates, where the primary refrigerant may flow in between the plates of the plate heat exchanger. By this design is also achieved that the downwardly flowing liquid is not admixed with upwardly flowing liquid, whereby the efficiency of the submerged evaporator with integrated heat exchanger is increased significantly.

In a further embodiment of the invention, a submerged evaporator has a plate heat exchanger built up of plates that are embossed with a pattern of guide grooves pointing towards the inner periphery of the casing at the upper edge of the plates with an angle between 0° and 90° in relation to level, and preferably with an angle between 20° and 80°. With these guide grooves is achieved a more rapid and more optimal leading back of unevaporated refrigerant as the refrigerant is conducted towards the inner periphery of the casing and then flows down along the sides of the casing and back to the bottom of the plate heat exchanger. In this way, the liquid separating action is enhanced since hereby is ensured that possible liquid carried with remains in the liquid separator/casing.

A submerged evaporator with integrated heat exchanger may furthermore include a condenser designed as a plate heat exchanger, which is mounted in the "dry" part of the casing, and which is separated from the evaporator section by a plate. Hereby is achieved possibility of performing condensing of the evaporated refrigerant or a part thereof.

Furthermore, a submerged evaporator with integrated plate heat exchanger may include a demister (drip-catcher), where the demister is mounted in the casing in immediate vicinity of the outlet connection for evaporated refrigerant. By such a demister it is possible to remove unwanted drops of unevaporated refrigerant before the vapour leaves the evaporator, and at the same time it is possible to minimise the size of the casing and still have the same capacity.

A submerged evaporator according to the invention may be adapted so that secondary refrigerant may flow to and from the plate heat exchanger via one inlet connection and one outlet connection, respectively, at the upper edge of the plates. Alternatively, the secondary refrigerant may flow to and from the plate heat exchanger via one connection at the bottom of the plates and one connection at the upper edge of the plates, respectively. A further alternative is that secondary refrigerant may flow to and from the plate heat exchanger via one connection at the bottom of the plates and two connections at the upper edge of the plates, respectively. With these connection possibilities, such a submerged evaporator may be adapted to many different operating conditions, where the different connecting arrangements may be associated with advantages for different reasons. Direction of flow may be chosen freely, depending on the actual operating conditions.

Finally, a submerged evaporator according to the invention may include a suction manifold disposed in the "dry" part of the casing and extending in longitudinal direction of the evaporator with a length substantially corresponding to the length of the plate heat exchanger. This manifold has the effect that, due to even suction of the gases, the liquid separation action is improved, and the size of the casing may be kept at a minimum level and possibly be reduced.

Figure 2:
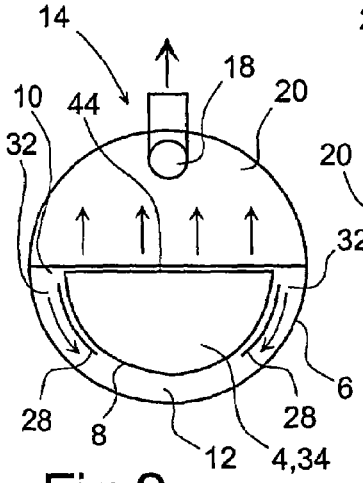
Figure 3:
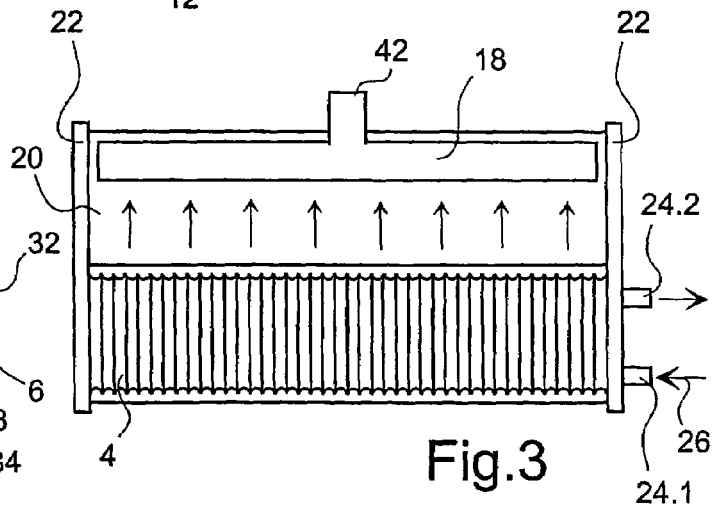
Figure 4:
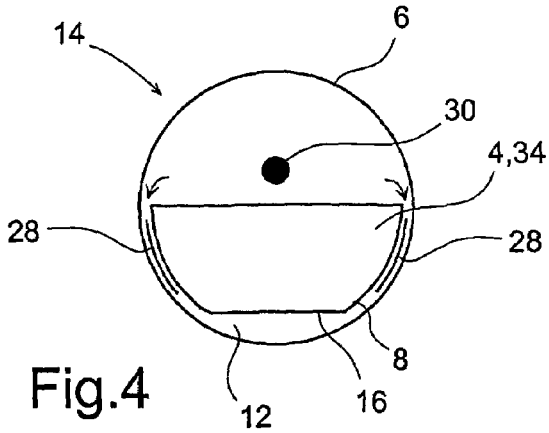
Figure 8:
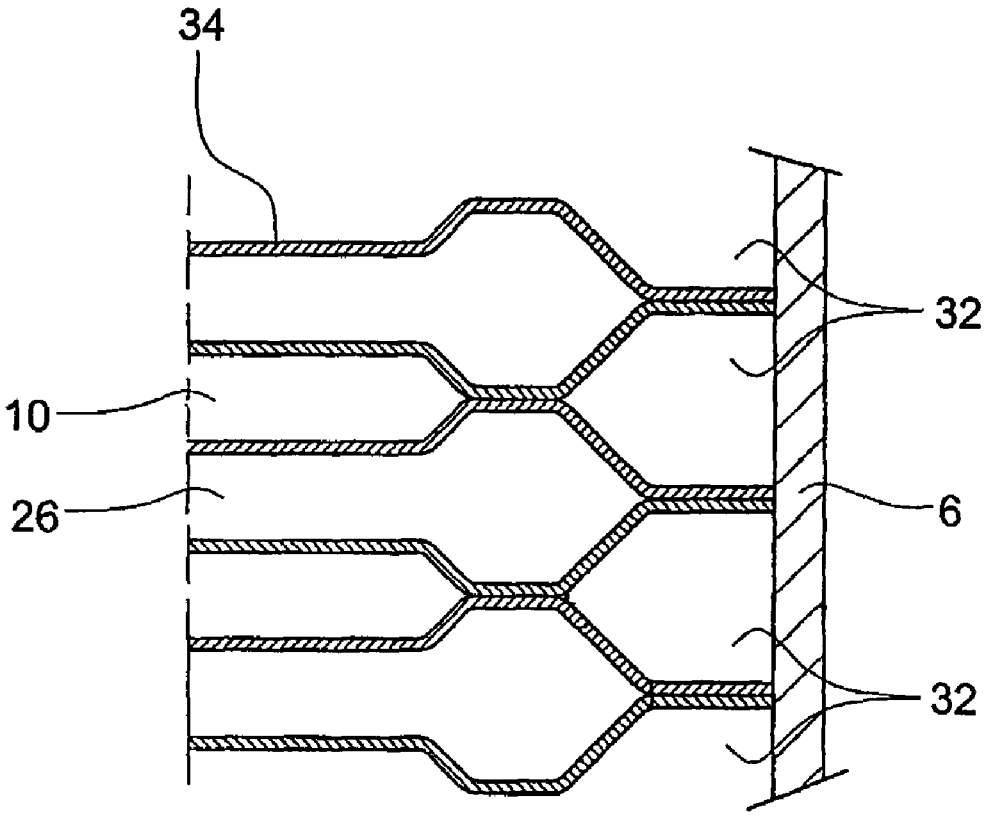

In the following, the invention is described with reference to the drawing, which, without being limiting, shows a preferred embodiment of a submerged evaporator according to the invention, where:

FIG. 1 shows the prior art type of submerged evaporator with submerged plate heat exchanger, FIG. 2 show a cross-section of a submerged evaporator with integrated plate heat exchanger according to the invention as seen from the end, FIG. 3 shows a submerged evaporator seen from the side, FIG. 4 shows position of guide plates, FIG. 5 shows possible design of guide grooves in the plates of the heat exchanger, FIG. 6 shows a submerged evaporator with integrated condenser and demister, FIG. 7 shows different connecting possibilities for the secondary refrigerant, and FIG. 8 shows a section through a part of the heat exchanger.

On FIG. 1 is seen a prior art submerged evaporator 2 with submerged plate heat exchanger 4. The casing 6 has a diameter which is typically 1.5 to 2 times larger than the diameter of the cylindric plate heat exchanger 4, which is necessary since the cylindric plate heat exchanger 4 is to be covered with the primary refrigerant liquid 10 while at the same time sufficient space is to remain for the liquid separator function. As a natural consequence of the diameter difference between the plate heat exchanger 4 and the surrounding casing 6, a relatively large volume is provided at the sides 8 of the heat exchanger, filled with primary refrigerant 10. This large volume is, however, also necessary in order to ensure that not too much mixing occurs between the refrigerant 10, which is on its way down to the evaporator bottom 12, and the refrigerant 10, which is brought to evaporate between the plates of the plate heat exchanger.

FIG. 2 shows a submerged evaporator 14 with integrated plate heat exchanger 4 according to the invention, where it is clearly seen that the heat exchanger 4 almost entirely fills the submerged part of the casing 6, and thus does not require so large filling with primary refrigerant 10 as with the prior art. The cross-section shown here illustrates that the heat exchanger 4 has a semi-cylindrical cross-section, but may of course be made with any conceivable kind of part cylindric cross-section or with another shape utilising the actual shape of the casing 6 optimally. Typically, the plate heat exchanger 4 may be provided with a cut-off or flat bottom 16 as depicted on FIG. 4.

On FIG. 3 is seen the same unit as on FIG. 2, but here in a longitudinal section of the unit 14, i.e. in a side view. On this Figure is seen a suction manifold 18 disposed inside the casing 6 in the dry part 20 constituted by the liquid separator. This manifold 18 provides an optimised utilisation of the evaporated refrigerant 10 and thereby an increased efficiency. At the end of the casing 6 is seen the lead-in of the connecting connections 24 where the secondary refrigerant 26 is conducted into and out of, respectively, the integrated plate heat exchanger 4. The direction of flow may be chosen freely depending on diverse conditions.

The integrated plate heat exchanger 4 may, as mentioned previously, be equipped with guide plates 28 between the sides of the heat exchanger 4 and of the casing 6. An example of placing guide plates 28 appears on FIG. 4. Moreover is seen that the casing 6 may be reinforced with one or more horizontal braces 30 fastened between the end plates 22. An alternative solution for ensuring that refrigerant 10, which is on its way back to the bottom 12 of the casing 6, is not mixed with and carried on by evaporated refrigerant 10, is welding of individual plates 34 along the sides 8 of the plate heat exchanger; alternatively, the individual plates may be designed so that they, in mounted condition, are lying closely together, whereby the same effect is attained. With this solution is ensured a passage 32 between heat exchanger 4 and casing 6, where refrigerant 10 may flow freely towards the bottom 12 of the casing 6. At the bottom 12 of the plate heat exchanger there is, of course, free access between the plates 34 so the primary refrigerant 10 may flow in between the plates 34 and be brought to evaporate.

The individual plates 34, which the plate heat exchanger 4 is made up of, are normally embossed with a pattern called guide grooves 36, see FIG. 5, and having the purpose of ensuring a more optimal heat transfer as well as contributing to respective refrigerants 10 being conducted optimally through the heat exchanger 4. At the upper edge 44 of the heat exchanger plates 34, these grooves 36 typically are directed against the casing 6 with an angle between 0° and 90°, and on FIG. 5 the angle is about 60° in relation to level. It is apparent that this angle may vary, depending on the design of the rest of the system. Also, it is clear that the direction of the mouth of these guide grooves 36 does not necessarily have any connection to the way in which the grooves 36 are designed in the remaining area of the plates 34. As previously mentioned, this design is determined from heat transmission aspects.

On FIG. 6 is seen a variant of a submerged evaporator 14 with integrated plate heat exchanger 4. In this variant, there is furthermore mounted a condenser 38 which in principle is designed as a plate heat exchanger 4 submerged at the bottom 12 of the casing 6, but mounted in the "dry" part 20 of the casing 6, and separated from the evaporator section by a plate. This plate may alternatively be constituted by welded plate cassettes in the condenser. The evaporator 14 shown on FIG. 6 is furthermore equipped with a demister 40 mounted in the casing 6 under the outlet 42 for evaporated refrigerant 10.

On FIG. 7 are seen three different possibilities for connecting 24 piping for the secondary refrigerant 26. FIG. 7.1 shows inlet 24.1 at the right side and outlet 24.2 at the left side of the plate heat exchanger 4, and FIG. 7.2 shows inlet 24.1 at the bottom 12 of the plate heat exchanger 4 and outlet 24.2 in the top 44 at the middle. Finally, FIG. 7.3 shows inlet 24.1 at the bottom 12 as shown on FIG. 7.2, but here there are two outlet connections 24.2 at the upper edge 44 corners of the heat exchanger 4. The shown connection possibilities are just examples and are not in any way to be viewed as limiting for the choice of connection arrangement. The secondary refrigerant may be single phase but may e.g. also be a condensing gas.

On FIG. 8 is shown a section through a part of a submerged evaporator surrounded by a casing 6. Inside the evaporator are shown heat exchanger plates 34 between which there is shown volumes containing the primary refrigerant 10 and volumes containing the secondary refrigerant 26. Between the casing and the heat exchanger plates 34 there are formed ducts 32 in which primary refrigerant is flowing.

Heat transmission occurs from the secondary refrigerant 26 to the primary refrigerant 10, whereby the primary refrigerant 10 is heated to a temperature above the boiling point of the medium. Therefore, boiling with development of steam bubbles in the primary refrigerant 10 occurs. These steam bubbles seek upwards in the ducts formed between the plates 34 of the heat exchanger. Simultaneously, the rising bubbles result in an upward liquid flow, increasing the efficiency of the evaporator. At the same time, the upward flow results in a downward flow in the ducts 32, where the primary refrigerant 10 flows downwards, primarily on liquid form. Thereby is ensured an efficient flow around and through the ducts of the evaporator.

The invention claimed is:

1. A submerged evaporator, comprising a substantially circular cylindrical, horizontally oriented casing and including at least one integrated plate heat exchanger, where the integrated plate heat exchanger has at least one inlet connection and at least one outlet connection for a secondary refrigerant, where the entire plate heat exchanger is confined within and substantially fills the bottom half of the casing, where a primary refrigerant can flow around the plate heat exchanger and a secondary refrigerant can flow through the plate heat exchanger, and where the uppermost part of the casing is used as a liquid separator, wherein the integrated plate heat exchanger is integrated with the evaporator and made with contour on an underside thereof that is substantially matched to the lower contour of a facing surface of the bottom end of the casing in proximity thereto and has a contour on a top side thereof that follows the liquid level of the primary refrigerant.

2. The submerged evaporator according to claim 1, wherein the longitudinal sides of the plate heat exchanger are closed for inflow or outflow of the primary refrigerant between the plates of the plate heat exchanger, and wherein the bottom of the plate heat exchanger there is provided at least one opening through which the primary refrigerant flows in between the plates of the plate heat exchanger.

3. The submerged evaporator according to claim 1, wherein longitudinal guide plates extending from an area in the vicinity of the top side of the plate heat exchanger and downwards against the bottom end of the casing are provided in longitudinal gaps appearing between plate heat exchanger and casing, where the downwardly extension of the guide plates has a magnitude so that a longitudinal area at the bottom of the plate heat exchanger is held free from guide plates, where the primary refrigerant is able to flow in between the plates of the plate heat exchanger.

4. The submerged evaporator according to claim 1, wherein the plates of the plate heat exchanger are embossed with a pattern of guide grooves pointing towards the inner periphery of the casing at the upper edge of the plates with an angle between 0° and 90° in relation to level, and preferably with an angle between 20° and 80°.

5. The submerged evaporator according to claim 1, wherein including a condenser shaped as a second plate heat exchanger, which is mounted in the "dry" part of the casing, and which is separated from the evaporator section by a plate.

6. The submerged evaporator according to claim 1, wherein including a demister which is mounted in the casing in immediate vicinity of the outlet connection for evaporated refrigerant.

7. The submerged evaporator according to claim 1, wherein being adapted in order that secondary refrigerant can flow to and from the plate heat exchanger via one inlet connection and one outlet connection, respectively, at the upper edge of the plates.

8. The submerged evaporator according to claim 1, wherein being adapted in order that secondary refrigerant can flow to and from the plate heat exchanger via one connection at the bottom of the plates and one connection at the upper edge of the plates, respectively.

9. The submerged evaporator according to claim 1, wherein being adapted in order that secondary refrigerant can flow to and from the plate heat exchanger via one connection at the bottom of the plates and two connections at the upper edge of the plates, respectively.

10. The submerged evaporator according to claim 1, wherein the casing contains a suction manifold disposed in the "dry" part of the casing and extending in longitudinal direction of the evaporator with a length substantially corresponding to the length of the plate heat exchanger.

11. The submerged evaporator according to claim 1, wherein the heat exchanger is partially cylindric.

12. The submerged evaporator according to claim 1, wherein the heat exchanger substantially entirely fills the submerged part of the casing.

* * * * *